US007271820B2

(12) United States Patent
Shimizu

(10) Patent No.: US 7,271,820 B2
(45) Date of Patent: Sep. 18, 2007

(54) IDLER MECHANISM, IMAGE FORMATION APPARATUS AND THERMAL TRANSFER PRINTER HAVING THE SAME

(75) Inventor: Daisuke Shimizu, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 277 days.

(21) Appl. No.: 11/111,730

(22) Filed: Apr. 22, 2005

(65) Prior Publication Data

US 2005/0243158 A1 Nov. 3, 2005

(30) Foreign Application Priority Data

Apr. 28, 2004 (JP) ..... 2004-132733

(51) Int. Cl.
*B41J 25/304* (2006.01)

(52) U.S. Cl. ..... 347/197

(58) Field of Classification Search ..... 347/197, 347/198, 220, 221, 222, 218, 217, 215, 32; 358/1.2

See application file for complete search history.

(56) References Cited

U.S. PATENT DOCUMENTS

2003/0001921 A1* 1/2003 Simmons et al. ..... 347/32
2003/0179389 A1* 9/2003 Kimura ..... 358/1.2

FOREIGN PATENT DOCUMENTS

JP 3093548 U 5/2003

* cited by examiner

*Primary Examiner*—K. Feggins
(74) *Attorney, Agent, or Firm*—Global IP Counselors, LLP

(57) ABSTRACT

Idler mechanism includes a pickup roller gear; a third pickup gear that meshes with the pickup roller gear; a pickup idler arm that is capable of pivoting around a pivot axis between the pickup roller gear side and the third pickup gear side; first and second pickup idler gears disposed at ends of the pickup idler arm; and a second pickup gear that rotates around a pivot axis and drives the first and second pickup idler gears. The first pickup idler gear meshes with the pickup roller gear when the pickup idler arm is pivoted toward the pickup roller gear, while the second pickup idler gear meshes with the third pickup gear when the pickup idler arm is pivoted toward the third pickup gear. At least one of the first and second pickup idler gears is always meshing with respective one of the pickup roller gear and the third pickup gear.

12 Claims, 6 Drawing Sheets

IDLER MECHANISM, IMAGE FORMATION APPARATUS AND THERMAL TRANSFER PRINTER HAVING THE SAME

BACKGROUND OF THE INVENTION

1. Field of the Invention

The present invention relates to idler mechanism and image formation apparatus having an idler mechanism. More specifically, the present invention relates to a thermal transfer printer having an idler mechanism.

2. Background Information

Types of thermal transfer printer that are known in the past include sublimation types and TA (thermo Autochrome) types. With a full-color thermal transfer printer, the printing is performed one color at a time. Accordingly, there has been known a mechanism for retracting paper that has been fed out and feeding it back out again to allow printing in multiple colors. To accomplish this, the motor is rotated in reverse, or an idler mechanism is utilized. FIG. 6 is a partial side schematic view of a standard sublimation type thermal transfer printer equipped with an idler mechanism. In this diagram, the gear teeth are indicated by dashed lines for the sake of simplicity.

A sublimation thermal transfer printer 100 includes a pickup lever 111 that moves a paper tray (not shown) up and down, a paper feed roller 112 that picks up the paper contained in the paper tray, a press roller 113 and spike roller 114 that convey paper while applying pressure, and a paper discharge roller 116 for discharging the paper.

The sublimation thermal transfer printer 100 is further equipped with various motors and gears. A feed motor 134 drives a feed gear 120*a*. First feed gears 120*a* and 120*b* are formed integrally and coaxially, and the first feed gear 120*b* meshes with a second feed gear 121*a*. The second feed gears 121*a* and 121*b* are formed integrally and coaxially, and the second feed gear 121*b* meshes with a feed roller gear 122.

The feed roller gear 122 is coupled fixedly and coaxially with the spike roller 114, such that the movement of the feed roller gear 122 is linked to that of the spike roller 114. The feed roller gear 122 meshes with a first pickup gear 127*a*. The first pickup gears 127*a* and 127*b* are formed integrally and coaxially, and the first pickup gear 127*b* meshes with a second pickup gear 128.

The second pickup gear 128 meshes with first and second pickup idler gears 129*a* and 129*b*. A spring (not shown) for generating rotational torque during swinging is inserted into the shaft of one of the first and second pickup idler gears 129*a* and 129*b*. These pickup idler gears 129*a* and 129*b* are connected by an L-shaped pickup idler arm 130 to the second pickup gear 128. The first pickup idler gear 129*a* meshes with a pickup roller gear 131 when the pickup idler arm 130 swings toward the pickup roller gear 131. The pickup roller gear 131 is coupled fixedly and coaxially with the paper feed roller 112, and its movement is linked to that of the paper feed roller 112. Meanwhile, the second pickup idler gear 129*b* meshes with a third pickup gear 132 when the pickup idler arm 130 swings toward the third pickup gear 132. In the state shown in FIG. 6, the first pickup idler gear 129*a* is meshed with the pickup roller gear 131.

The third pickup gear 132 meshes with the pickup roller gear 131. The pickup roller gear 131 in turn meshes with an eject roller gear 133. The eject roller gear 133 is coupled fixedly and coaxially with the paper discharge roller 116, and its movement is linked to that of the paper discharge roller 116. In this manner, the paper is shifted to the paper ejection direction (right hand side direction as viewed in FIG. 6).

An idler stopper 101 is provided coaxially with the pickup gear 127*a*. A protrusion 130*b* is formed on the pickup idler arm 130 so as to come into contact with the idler stopper 101. In the state in FIG. 6, the protrusion 130*b* is biased upward by the idler stopper 101, so the swinging angle of the idler arm 130 is prevented, and the first pickup idler gear 129*a* is meshed with the pickup roller gear 131.

FIG. 7 is a partial side see-through view of the sublimation thermal transfer printer 100 during the paper feed operation. The pickup lever 111 is driven and its distal end rises during the paper feed operation. The paper tray is lifted up by this distal end, and when the uppermost sheet of paper hits the paper feed roller 112, it is fed out by the rotation of the paper feed roller 112. At this point, the raising of the pickup lever 111 causes the idler stopper 101 to rotate clockwise, stopping its biasing of the protrusion 130*b*. Since the second pickup gear 128 rotates in the direction indicated by the arrow 210 during the paper feed operation, the pickup idler arm 130 is also subjected to rotational torque in the direction of the arrow 210. Therefore, the pickup idler arm 130 rotates toward the third pickup gear 132 and the second pickup idler gear 129*b* meshes with the third pickup gear 132.

As the third pickup gear 132 rotates in the direction of the arrow 210, the second pickup idler gear 129*b* rotates in the direction of the arrow 211, and the third pickup gear 132 rotates in the direction of the arrow 212. Then, the pickup roller gear 131 rotates in the direction of the arrow 213, and the paper feed roller 112 rotates in the direction of the arrow 214.

However, with the sublimation thermal transfer printer 100 shown in FIGS. 6 and 7, a spring is necessary for obtaining the oscillation torque of the idler mechanism, which makes the structure complicated. Also with such structure, a situation can occur in which neither of the first and second pickup idler gears 129*a* and 129*b* is meshed with either the pickup roller gear 131 or the third pickup gear 132.

In view of the above, it will be apparent to those skilled in the art from this disclosure that there exists a need for improved idler mechanism, image formation apparatus, and thermal transfer printer that overcome problems of the prior art. This invention addresses this need in the art as well as other needs, which will become apparent to those skilled in the art from this disclosure.

SUMMARY OF THE INVENTION

It is an object of the present invention to provide an idle mechanism having, an image formation apparatus, and a thermal transfer printer having such idler mechanism, in which rotational torque is obtained without a spring.

An idler mechanism in accordance with the first aspect of the present invention includes a first driven gear; a second driven gear, the second driven gear meshing with the first driven gear; a drive gear that is rotatably supported around a pivot axis; a bent-shaped idler arm disposed on the pivot axis, the idler arm being pivotable between the first and second driven gear due to rotational torque generated by rotation of the driven gear; a first idler gear that is disposed at one side of the idler arm and is driven by the drive gear, the first idler gear meshing with the first driven gear when the idler arm is pivoted toward the first driven gear; and a second idler gear that is disposed on the other side of the idler arm and is driven by the drive gear, the second idler gear meshing with the second driven gear when the idler arm is pivoted toward the second driven gear. At least one of the first and second idler gears is always meshing with respective one of the first and second driven gears.

The idler mechanism in accordance with the second aspect of the present invention is the idler mechanism of the first aspect of the present invention, in which the idler arm is designed to assume one of a pivotable state and an unpivotable state, and the first idler gear meshes with the first driven gear when the idler arm is in the unpivotable state.

The idler mechanism in accordance with the third aspect of the present invention is the idler mechanism of the second aspect of the present invention, in which when the idler arm is in the pivotable state, positions at which the first and second idler gears mesh with the drive gear move in a rotational direction of the rotation of the drive gear as the drive gear rotates, thereby pivoting the idler arm in the same rotational direction.

The idler mechanism in accordance with the fourth aspect of the present invention is the idler mechanism of the second aspect of the present invention, in which when the idler arm is in the pivotable state, a rotational direction in which the second driven gear is rotated is the same regardless of a rotational direction of the drive gear.

The image formation apparatus in accordance with the fifth aspect of the present invention includes a main frame; a platen roller rotatably supported by the main frame; a header portion pivotably supported by the main frame; a motor; an idler mechanism; and a paper feed roller disposed fixedly and coaxially around the first driven gear. The idler mechanism includes a first driven gear, a second driven gear, the second driven gear meshing with the first driven gear, a drive gear that is rotatably supported around a pivot axis and is driven by the motor, a bent-shaped pickup idler arm disposed on the pivot axis, the idler arm being pivotable between the first and second driven gear due to rotational torque generated by rotation of the driven gear, a first idler gear that is disposed at one side of the idler arm and is driven by the drive gear, the first idler gear meshing with the first driven gear when the idler arm is pivoted toward the first drive gear, and a second idler gear that is disposed on the other side of the idler arm and is driven by the drive gear, the second idler gear meshing with the second driven gear when the idler arm is pivoted toward the second drive gear. At least one of the first and second pickup idler gears is always meshing with respective one of the first and second driven gears.

The image formation apparatus in accordance with the sixth aspect of the present invention is the image formation apparatus of the fifth aspect of the present invention, in which the idler arm is designed to assume one of a pivotable state and an unpivotable state, and the first idler gear meshes with the first driven gear when the idler arm is in the unpivotable state.

The image formation apparatus in accordance with the seventh aspect of the present invention is the image formation apparatus of the fifth aspect of the present invention, further including an eject roller gear that meshes with the first driven gear; and a paper discharge roller disposed fixedly and coaxially around the eject roller.

The image formation apparatus in accordance with the eighth aspect of the present invention is the image formation apparatus of the fifth aspect of the present invention, further including a pickup lever that is selectively positioned to engage and disengage an engagement portion formed on the idler arm. The idler arm is in the pivotable state when the pickup lever is positioned to engage the engagement portion, and the idler arm is in the unpivotable state when the pickup lever is positioned to disengage the engagement portion.

The image formation apparatus in accordance with the ninth aspect of the present invention is the image formation apparatus of the sixth aspect of the present invention, in which when the idler arm is in the pivotable state, positions at which the first and second idler gears mesh with the drive gear move in a rotational direction of the rotation of the drive gear as the drive gear rotates, thereby pivoting the idler arm in the same rotational direction.

The image formation apparatus in accordance with the tenth aspect of the present invention is the image formation apparatus of the sixth aspect of the present invention, in which when the idler arm is in the pivotable state, a rotational direction in which the second driven gear is rotated is the same regardless of a rotational direction of the drive gear.

The image formation apparatus in accordance with the eleventh aspect of the present invention is the image formation apparatus of the fifth aspect of the present invention, in which the header portion is a thermal header, and the image formation apparatus is a thermal transfer printer.

The image formation apparatus in accordance with the twelfth aspect of the present invention is the image formation apparatus of the eleventh aspect of the present invention, in which the image formation apparatus is a sublimation thermal transfer printer.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
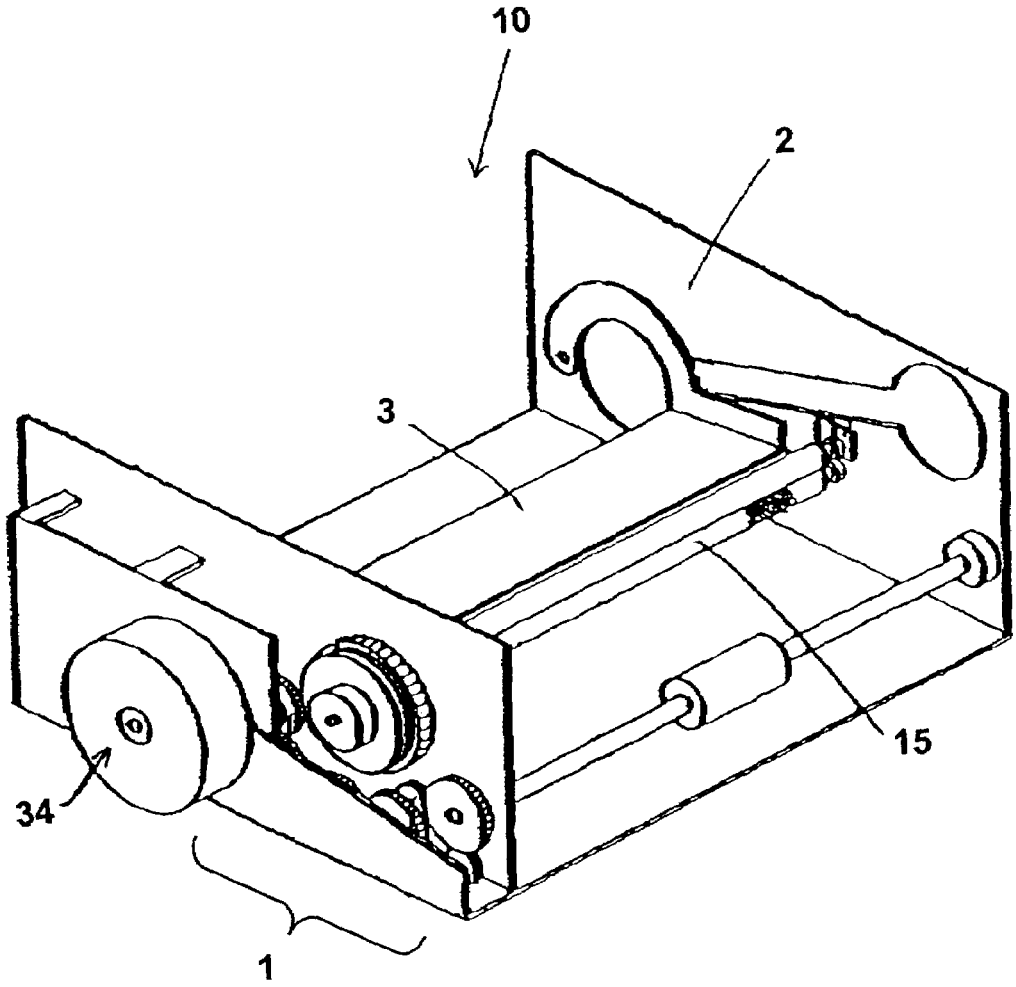
FIG. 1 is a schematic perspective view of a sublimation thermal transfer printer having a pickup idler mechanism in accordance with the embodiment of the present invention.
Figure 2:
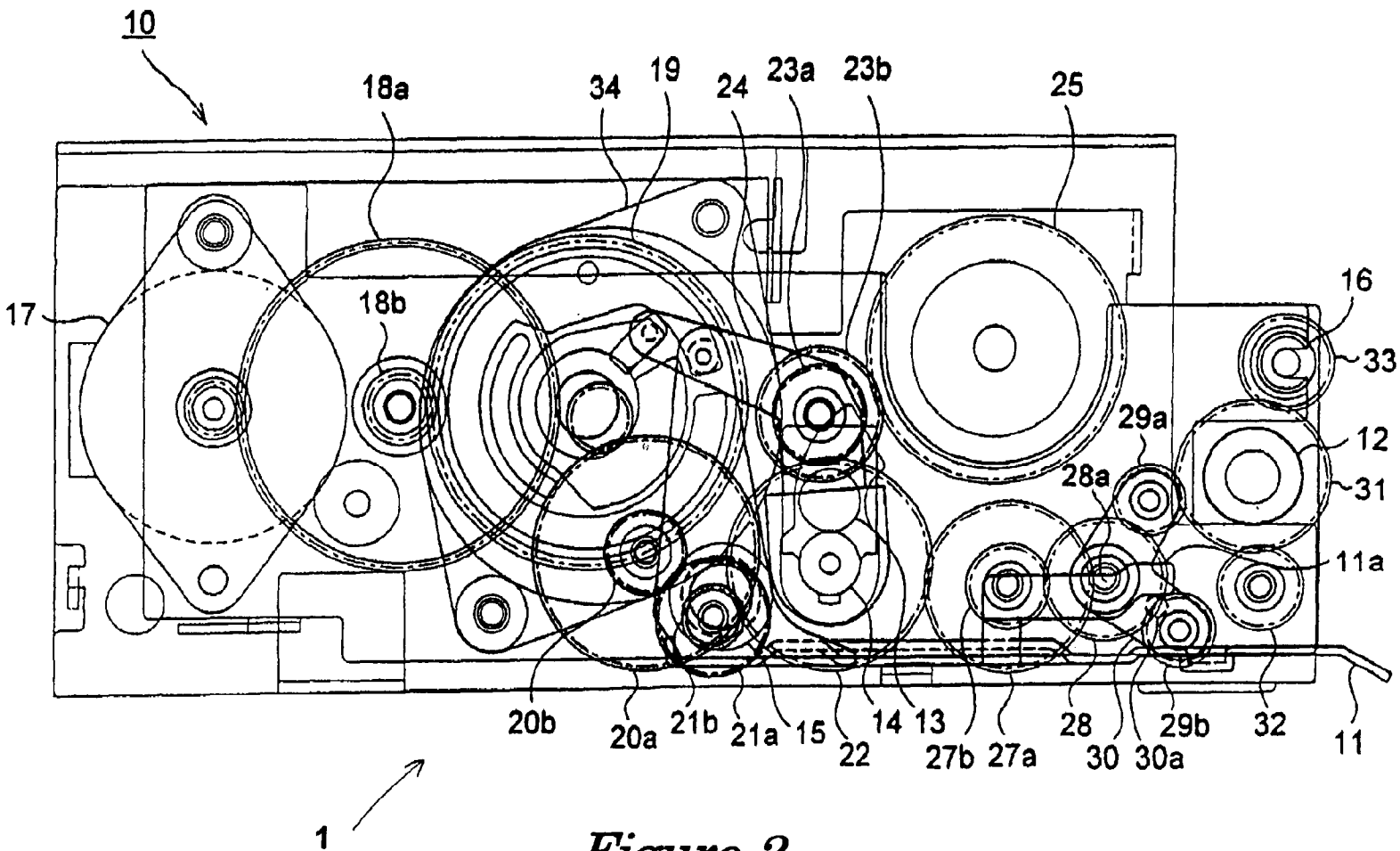
FIG. 2 is a partial side schematic view of the pickup idler mechanism in accordance with the embodiment of the present invention.

A sublimation type thermal transfer printer 10 will now be described as an example of thermal transfer printer. In the drawings, the gear teeth are indicated by dashed lines for the sake of simplicity. FIG. 1 is a schematic perspective view of a sublimation thermal transfer printer 10 having a pickup idler mechanism 100. FIG. 2 is a schematic side view of the pickup idler mechanism 1. The sublimation thermal transfer printer 10 includes a main frame 2, a thermal head 3 pivotably coupled to the main frame 2, a pickup lever 11 that moves a paper tray (not shown) up and down, a paper feed roller 12 that picks up the paper contained in the paper tray, a press roller 13 and a spike roller 14 that convey paper therebetween while applying pressure, a platen roller 15 which is supported by the main frame 2 and against which the thermal head 3 is pressed, a paper discharge roller 16 for discharging the paper, and a pickup idler mechanism 1.

The sublimation thermal transfer printer 10 is also equipped with various motors and gears. A motor gear 18*a* is driven in order to switch between the paper feed operation and the discharge operation. The motor gears 18*a* and 18*b* are formed integrally and coaxially, and the motor gear 18*b* meshes with a cam gear 19.

A feed motor 34 drives the first feed gear 20*a*. The first feed gears 20*a* and 20*b* are formed integrally and coaxially, and the first feed gear 20*b* meshes with a second feed gear 21*a*. The second feed gears 21*a* and 21*b* are formed integrally and coaxially, and the second feed gear 21*b* meshes with a feed roller gear 22.

The feed roller gear 22 is disposed fixedly and coaxially with the spike roller 14, and its movement is linked to that of the spike roller 14. The feed roller gear 22 meshes with an idler gear 23*a*. This idler gear 23*a* is connected by an L-shaped idler arm 24 to the feed roller gear 22. The idler gears 23*a* and 23*b* are formed integrally and coaxially, and the idler gear 23*b* meshes with a clutch gear 25 or the cam gear 19. In the state shown in FIG. 2, the idler gear 23*b* is meshed with the clutch gear 25.

The feed roller gear 22 meshes with the first pickup gear 27*a*. The first pickup gears 27*a* and 27*b* are formed integrally and coaxially, and the first pickup gear 27*b* meshes with a second pickup gear 28 (an example of the drive gear), which is rotatably supported around a pivot axis 28*a*.

The pickup idler mechanism 1 includes the second pickup gear 28, a first pickup idler gear 29*a*, a second pickup idler gear 29*b*, a third pickup gear 32 (an example of the second driven gear), and a pickup roller gear 31 (an example of the first driven gear). The second pickup gear 28 meshes with first and second pickup idler gears 29*a* and 29*b*. These pickup idler gears 29*a* and 29*b* are connected by an L-shaped pickup idler arm 30 to the second pickup gear 28. A protrusion 30*a* (an example of the engagement portion) is unitarily formed on the pickup idler arm 30. When this protrusion 30*a* is latched with a latching component 11 a which is formed by cutting and raising a portion of the pickup lever 11 in an L-shape, pivoting of the pickup idler arm 30 is stopped. Also, while the protrusion 30*a* latches with the latching component 11*a*, the pickup idler arm 30 is kept at a position where the first pickup idler gear 29*a* meshes with the pickup roller gear 31 (the state shown in FIG. 4), regardless of the rotational direction of the second pickup gear 28. The pickup lever 11 is made from sheet metal, so the latching component 11*a* can be easily formed.

The first pickup idler gear 29*a* meshes with a pickup roller gear (first driven gear) 31 when the pickup idler arm 30 swings toward the pickup roller gear 31. The pickup roller gear 31 is disposed fixedly and coaxially with the paper feed roller 12, and its movement is linked to that of the paper feed roller 12. Meanwhile, the second pickup idler gear 29*b* meshes with a third pickup gear (second driven gear) 32 when the pickup idler arm 30 is pivoted toward the third pickup gear 32. In the state shown in FIG. 2, the first pickup idler gear 29*a* is meshed with the pickup roller gear 31.

In this state, the third pickup gear 32 is meshes with the pickup roller gear 31. The pickup roller gear 31 in turn meshes with an eject roller gear 33. The eject roller gear 33 is disposed fixedly and coaxially with the paper discharge roller 16, and its movement is linked to that of the paper discharge roller 16.

Pickup Idler Mechanism 1

Figure 3:
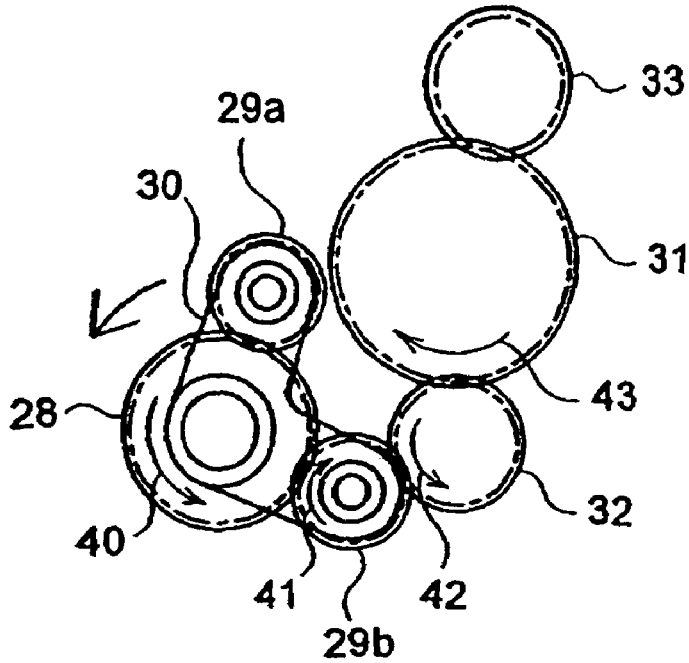
FIG. 3 is a side view of the pickup idler mechanism in accordance with the embodiment of the present invention during the paper feed operation.

The mechanism of the pickup idler mechanism 1 will now be described. FIG. 3 is a side view of the pickup idler mechanism during the paper feed operation, while FIG. 4 is a side view of the pickup idler mechanism during the paper discharge operation, and FIG. 5 is a side view of the pickup idler mechanism during the paper re-feed operation.

The rotation of the second pickup gear 28 generates rotational torque in the rotational direction of the second pickup gear 28, and this rotational torque moves the first and second pickup idler gear 29*a* and 29*b*. The second pickup gear 28 is meshed with the first and second pickup idler gear 29*a* and 29*b*. Accordingly, when the second pickup gear 28 is rotated in the direction of arrow 45 as shown in FIG. 4, its rotational torque shifts the portion of the second pickup gear 28 that meshes with the first pickup idler gear 29*a* in the direction of the arrow 45. Thus, the pickup idler arm 30 pivots toward the pickup roller gear 31 side, while maintaining the meshing of the first pickup idler gear 29*a* with the pickup roller gear 31 (as shown in FIG. 4). On the other hand, when the second pickup gear 28 is rotated in the direction of the arrow 40 as shown in FIG. 3, the pickup idler arm 30 also swings in the direction of arrow 40, such that the portion of the second pickup gear 28 that meshes with the second pickup idler gear 29*b* shifts toward the third pickup gear 32 (the direction of the arrow 40), while maintaining the meshing of the second pickup idler gear 29*b* with the third pickup gear 32 (as shown in FIG. 4).

Figure 4:
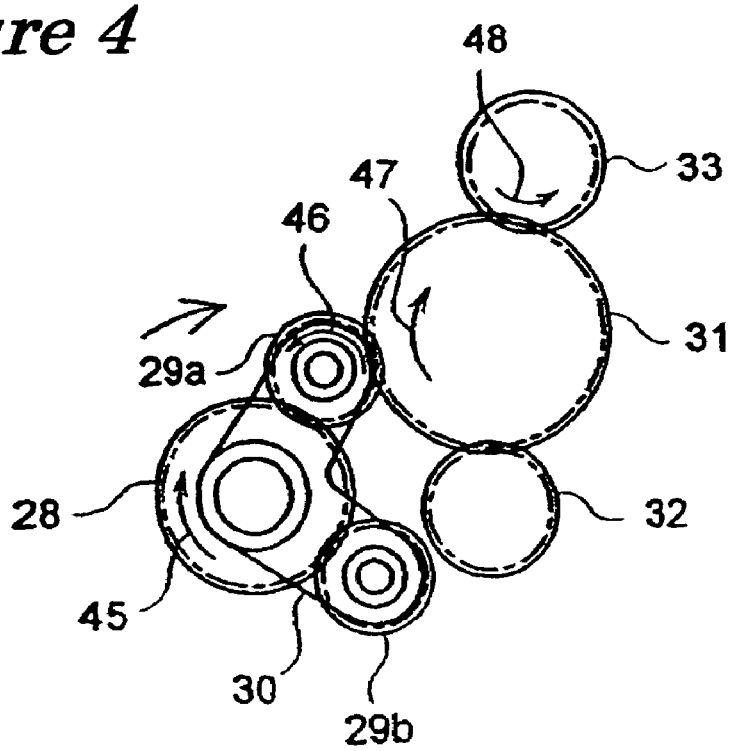
FIG. 4 is a side view of the pickup idler mechanism in accordance with the embodiment of the present invention during the paper discharge operation.
Figure 5:
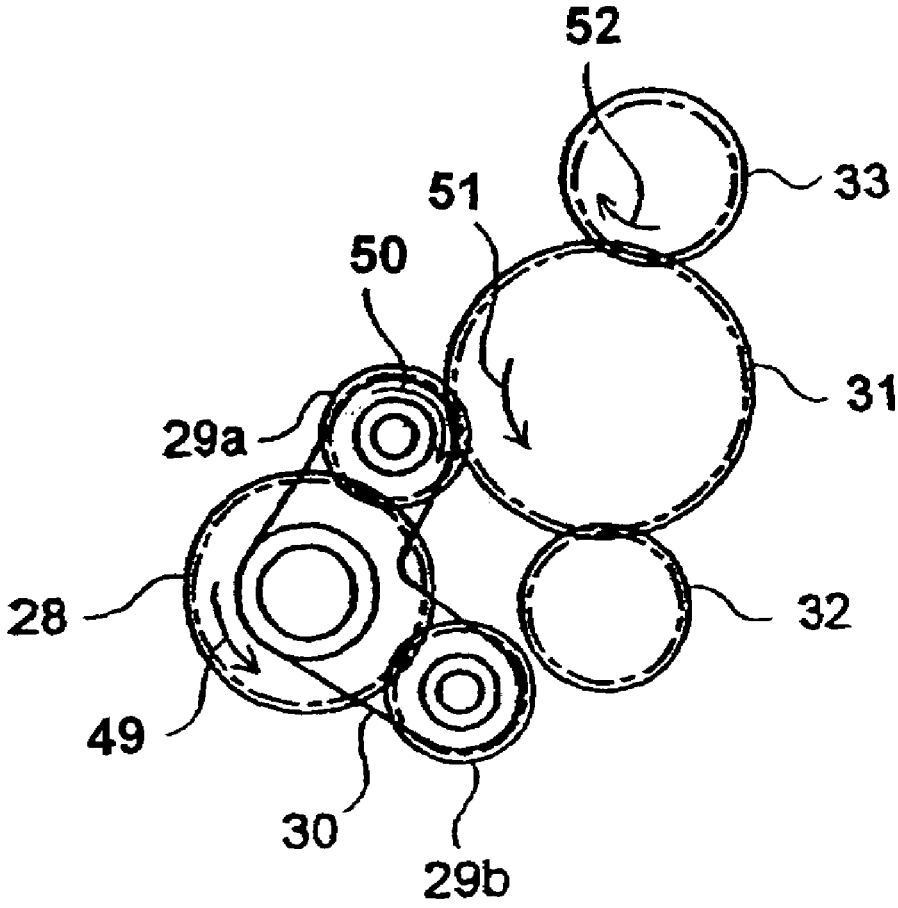
FIG. 5 is a side view of the pickup idler mechanism in accordance with the embodiment of the present invention during the paper re-feed operation.
Figure 6:
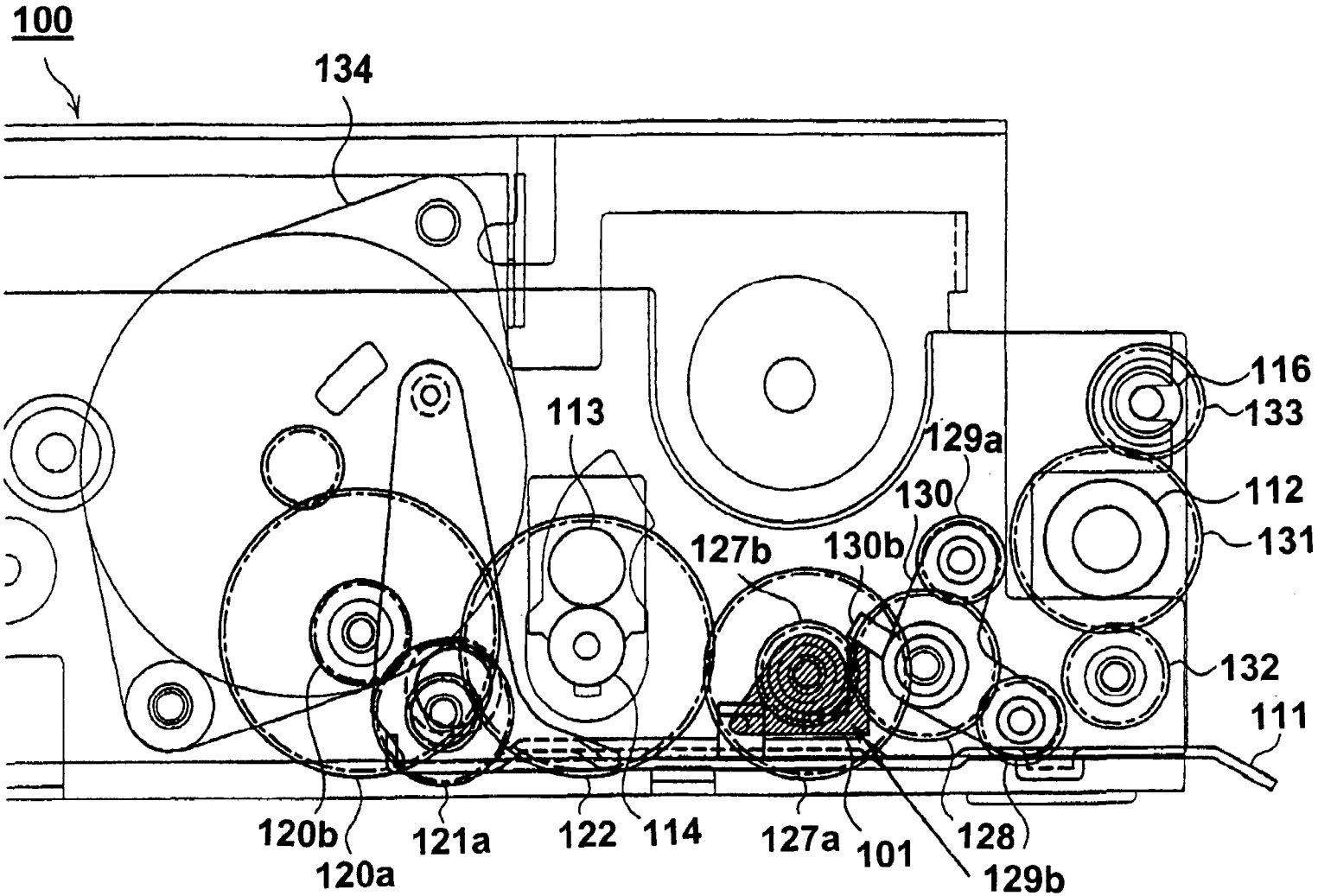
Figure 6 PRIOR ART
FIG. 6 is a partial schematic side view of a conventional pickup idler mechanism in a sublimation type thermal transfer printer.
Figure 7:
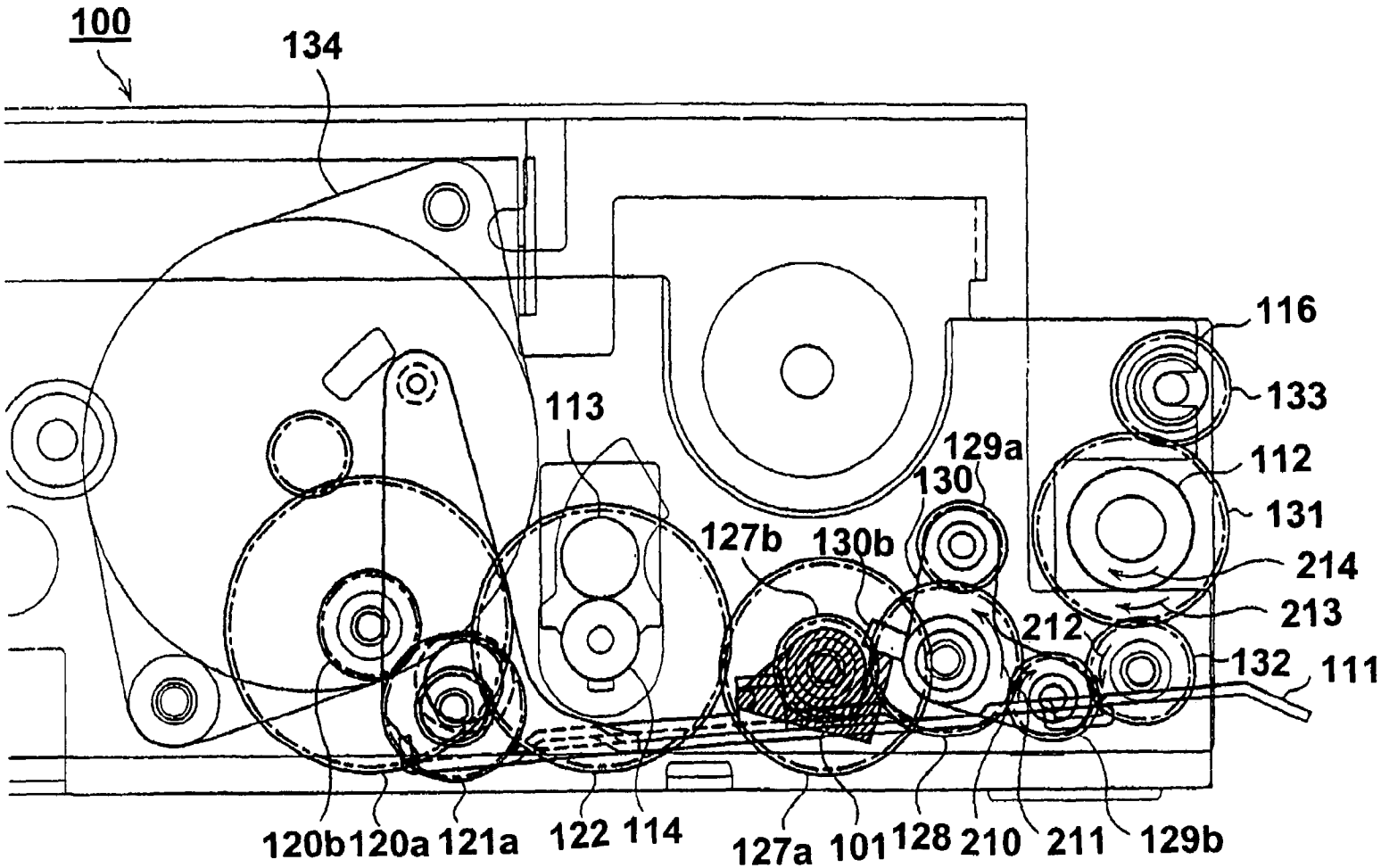
Figure 7 PRIOR ART
FIG. 7 is a partial schematic side view of the conventional pickup idler mechanism shown in FIG. 6 during the paper feed operation.

To move the first and second pickup idler gears 29*a* and 29*b* from the state in FIG. 4 to that in FIG. 3, in other words, to pivot the pickup idler arm 30, it suffices to merely rotate the second pickup gear 28 in the reverse direction (the direction of the arrow 40). The rotation of the second pickup gear 28 generates rotational torque in the direction of the arrow 40, which shifts the portion of the second pickup gear 28 that is meshed with the first pickup idler gear 29*a* in the direction of the arrow 40. The pickup idler arm 30 therefore rotates from the state in FIG. 4 to that in FIG. 3.

In this embodiment, the angle of the L-shape of the pickup idler arm 30 is smaller than that of conventional L-shaped pickup idler arm. Also, at least either the first pickup idler gear 29*a* or the second pickup idler gear 29*b* is always in contact with the pickup roller gear 31 or the third pickup gear 32. Thus, while the first pickup idler gear 29*a* is engaging the pickup roller gear 31 as shown in FIG. 4, once the pickup idler arm 30 starts pivoting in the opposite direction (the direction of the arrow 40), the first pickup idler gear 29*a* is pushed away from the pickup roller gear 31. At the same time, the second pickup idler gear 29*b* engages with the third pickup gear 32.

Once the second pickup idler gear 29*b* meshes with the third pickup gear 32 (the state in FIG. 3), the rotation of the second pickup gear 28 in the direction of the arrow 41 has an effect of pushing the pickup idler arm 30 and the second pickup idler gear 29*b* in the same rotational direction (the direction of the arrow 45). Accordingly, the second pickup idler gear 29*b* can be securely meshed with the third pickup gear 32.

With the pickup idler mechanism described above, there is no need to use a spring or to form the gears in any special shape in order to obtain rotational torque.

Operation of Paper Conveyance Operation

The operation of the pickup idler mechanism during the paper conveyance operation will now be described in details. During the paper feeding operation, the rotation of the cam gear 19 causes the pickup lever 11 to pivot from the state in FIG. 2. Since the paper tray is resting on top of and near the distal end of this pickup lever 11, the paper tray is lifted up by the distal end of the pickup lever 11 as the pickup lever 11 is pivoted. The uppermost sheet of paper contained in the paper tray then comes into contact with the paper feed roller 12. As a result, the uppermost sheet of paper is fed out by the rotation of the paper feed roller 12.

The following components operate as follows in order to rotate the paper feed roller 12 in the paper feed direction during this paper feed operation. First, the feed motor 34 drives the first feed gear 20*a*. This results in the rotation of the first feed gear 20*b*, the second feed gears 21*a* and 21*b*, the feed roller gear 22, the first pickup gears 27*a* and 27*b*, and the second pickup gear 28. The rotational direction of the feed motor 34 is controlled so as to make the second pickup gear 28 rotate in the direction indicated by the arrow 40.

Since the pickup lever 11 is raised up during the paper feed operation, the protrusion 30*a* is unlatched from the latching component 11*a*, allowing the pickup idler arm 30 to swing. Therefore, rotational torque is generated, which pivots the pickup idler arm 30 in the rotational direction of the second pickup gear 28, the pivot axis of the pickup idler arm 30. Since the second pickup gear 28 is rotating in the direction of the arrow 40 at this point, the pickup idler arm 30 also pivots in the same direction. Consequently, the second pickup idler gear 29*b* meshes with the third pickup gear 32.

When this happens, the second pickup idler gear 29*b* rotates in the direction of the arrow 41, the third pickup gear 32 in the direction of the arrow 42, and the pickup roller gear 31 in the direction of the arrow 43, all according to the rotation of the second pickup gear 28, which is rotating in the direction of the arrow 40. As a result, the paper feed roller 12, which is disposed fixedly and coaxially with the pickup roller gear 31, rotates in the direction of the arrow 43, that is, in the paper feed direction.

Meanwhile, during the paper discharge operation, the following components operate as follows in order to rotate the paper discharge roller 16 in the paper discharge direction. Normally, the pickup lever 11 is lowered during the paper discharge operation (an example of the unpivotable state of the idler arm). Then, the feed motor 34 drives the first feed gear 20*a*. This results in the rotation of the first feed gear 20*b*, the second feed gears 21*a* and 21*b*, the feed roller gear 22, the first pickup gears 27*a* and 27*b*, and the second pickup gear 28. The rotational direction of the feed motor 34 is controlled so as to make the second pickup gear 28 rotate in the direction indicated by the arrow 45.

Since the pickup lever 11 is lowered during the paper discharge operation, the protrusion 30*a* is latched by the latching component 11*a*, keeping the pickup idler arm 30 from pivoting. Therefore, the second pickup idler gear 29*b* moves away from the third pickup gear 32 and the first pickup idler gear 29*a* meshes with the pickup roller gear 31 regardless of the rotational direction of the second pickup gear 28. When this happens, the first pickup idler gear 29*a* rotates in the direction of the arrow 46, the pickup roller gear 31 in the direction of the arrow 47, and the eject roller gear 33 in the direction of the arrow 48, all according to the rotation of the second pickup gear 28, which is rotating in the direction of the arrow 45. As a result, the paper discharge roller 16, which is disposed fixedly and coaxially with the eject roller gear 33, rotates in the direction of the arrow 48, that is, in the paper discharge direction.

Even when the pickup lever 11 is not lowered (an example of the pivotable state of the idler arm) at the beginning of the paper discharge operation, the paper discharge roller 16 can still rotate in the paper discharge direction. This is because when the pickup lever 11 is not lowered, the pickup idler arm 30 remains pivotable. As the second pickup gear 28 rotates, a rotational torque in the same rotational direction is generated in the second pickup gear 28, which is the pivot axis of the pickup idler arm 30. Accordingly, since the second pickup gear 28 is now rotating in the direction of the arrow 45, the pickup idler arm 30 also pivots in the same direction. Consequently, the first pickup idler gear 29*a* meshes with the pickup roller gear 31. When this happens, the first pickup idler gear 29*a* rotates in the direction of the arrow 46, the pickup roller gear 31 in the direction of the arrow 47, and the eject roller gear 33 in the direction of the arrow 48, all according to the rotation of the second pickup gear 28, which is rotating in the direction of the arrow 45. As a result, the paper discharge roller 16, which is disposed fixedly and coaxially with the eject roller gear 33, rotates in the direction of the arrow 48, that is, in the paper discharge direction.

During the paper re-feed operation, the paper discharge roller 16 rotates in the opposite direction from the direction of the arrow 48, as shown in FIG. 5. The feed motor 34 is rotated in the same direction as during the paper feed operation, with the pickup lever 11 being lowered. This causes the press roller 13 and spike roller 14 to rotate in the paper feed direction, and also the second pickup gear 28 to rotate in the paper feed direction, which is the direction of an arrow 49. During the paper re-feed direction, since the pickup lever 11 is lowered, the pickup idler arm 30 remains in the position shown in FIG. 5, and the first pickup idler gear 29*a* remains meshed with the pickup roller gear 31. As the second pickup gear 28 rotates in the direction of the arrow 49, the first pickup idler gear 29*a* rotates in the direction of the arrow 50, the pickup roller gear 31 in the direction of the arrow 51, and the eject roller gear 33 in the direction of the arrow 52, all according to the rotation of the second pickup gear 28. Accordingly, the paper discharge roller 16 rotates in the direction of the arrow 52, which is the paper re-feed direction (opposite from the paper discharge direction). The paper is re-fed in this manner.

Although the present invention is embodied in a sublimation or TA types thermal transfer printer in the above-described embodiment, the idler mechanism of the present invention can be applied to any image forming apparatus to which paper is fed and from which paper is discharged.

With the present invention, since at least either the first pickup idler gear of the second pickup idler gear is always in contact with the pickup roller gear or the third pickup gear, rotational torque can be generated in the idler arm without having to provide a spring in the first or second pickup idler gear. Accordingly, fewer components are required, which reduces manufacturing cost.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least±5% of the modified term if this deviation would not negate the meaning of the word it modifies.

This application claims priority to Japanese Patent Application No. 2004-132733. The entire disclosure of Japanese Patent Application No. 2004-132733 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An idler mechanism, comprising:

a first driven gear;

a second driven gear, the second driven gear meshing with the first driven gear;

a drive gear that is rotatably supported around a pivot axis;

a bent-shaped idler arm disposed on the pivot axis, the idler arm being pivotable between the first and second driven gear due to rotational torque generated by rotation of the driven gear;

a first idler gear that is disposed at one side of the idler arm and is driven by the drive gear, the first idler gear meshing with the first driven gear when the idler arm is pivoted toward the first driven gear; and a second idler gear that is disposed on the other side of the idler arm and is driven by the drive gear, the second idler gear meshing with the second driven gear when the idler arm is pivoted toward the second driven gear;

wherein at least one of the first and second idler gears is always meshing with respective one of the first and second driven gears.

2. The idler mechanism according to claim 1, wherein the idler arm is designed to assume one of a pivotable state and an unpivotable state, and the first idler gear meshes with the first driven gear when the idler arm is in the unpivotable state.

3. The idler mechanism according to claim 2, wherein when the idler arm is in the pivotable state, positions at which the first and second idler gears mesh with the drive gear move in a rotational direction of the rotation of the drive gear as the drive gear rotates, thereby pivoting the idler arm in the same rotational direction.

4. The idler mechanism according to claim 2, wherein when the idler arm is in the pivotable state, a rotational direction in which the second driven gear is rotated is the same regardless of a rotational direction of the drive gear.

5. An image formation apparatus, comprising:

a main frame;

a platen roller rotatably supported by the main frame;

a header portion pivotably supported by the main frame;

a motor;

an idler mechanism, including a first driven gear, a second driven gear, the second driven gear meshing with the first driven gear, a drive gear that is rotatably supported around a pivot axis and is driven by the motor, a bent-shaped pickup idler arm disposed on the pivot axis, the idler arm being pivotable between the first and second driven gear due to rotational torque generated by rotation of the driven gear, a first idler gear that is disposed at one side of the idler arm and is driven by the drive gear, the first idler gear meshing with the first driven gear when the idler arm is pivoted toward the first drive gear, and a second idler gear that is disposed on the other side of the idler arm and is driven by the drive gear, the second idler gear meshing with the second driven gear when the idler arm is pivoted toward the second drive gear; and a paper feed roller disposed fixedly and coaxially around the first driven gear;

wherein at least one of the first and second idler gears is always meshing with respective one of the first and second driven gears.

6. The image formation apparatus according to claim 5, wherein the idler arm is designed to assume one of a pivotable state and an unpivotable state, and the first idler gear meshes with the first driven gear when the idler arm is in the unpivotable state.

7. The image formation apparatus according to claim 6, further comprising a pickup lever that is selectively positioned to engage and disengage an engagement portion formed on the idler arm, wherein the idler arm is in the pivotable state when the pickup lever is positioned to engage the engagement portion, and the idler arm is in the unpivotable state when the pickup lever is positioned to disengage the engagement portion.

8. The image formation apparatus according to claim 6, wherein when the idler arm is in the pivotable state, positions at which the first and second idler gears mesh with the drive gear move in a rotational direction of the rotation of the drive gear as the drive gear rotates, thereby pivoting the idler arm in the same rotational direction.

9. The image formation apparatus according to claim 6, wherein when the idler arm is in the pivotable state, a rotational direction in which the second driven gear is rotated is the same regardless of a rotational direction of the drive gear.

10. The image formation apparatus according to claim 5, further comprising an eject roller gear that meshes with the first driven gear; and a paper discharge roller disposed fixedly and coaxially around the eject roller.

11. The image formation apparatus according to claim 5, wherein the header portion is a thermal header, and the image formation apparatus is a thermal transfer printer.

12. The image formation apparatus according to claim 11, wherein the image formation apparatus is a sublimation thermal transfer printer.

* * * * *